US008721003B2

(12) United States Patent
Waite et al.

(10) Patent No.: US 8,721,003 B2
(45) Date of Patent: May 13, 2014

(54) FOLDING CHAIR WITH MOLDED COMPONENTS

(75) Inventors: Donald Waite, North Ogden, UT (US); Ed VanNimwegen, North Ogden, UT (US); Rich Howe, Pleasant View, UT (US)

(73) Assignee: Lifetime Products, Inc., Clearfield, UT (US)

( * ) Notice: Subject to any disclaimer, the term of this patent is extended or adjusted under 35 U.S.C. 154(b) by 16 days.

(21) Appl. No.: 12/327,678

(22) Filed: Dec. 3, 2008

(65) Prior Publication Data

US 2009/0146467 A1 Jun. 11, 2009

Related U.S. Application Data

(60) Provisional application No. 60/992,834, filed on Dec. 6, 2007, provisional application No. 61/050,461, filed on May 5, 2008.

(51) Int. Cl.
*A47C 4/00* (2006.01)
*A47C 7/00* (2006.01)

(52) U.S. Cl.
USPC ..... 297/440.21; 297/55; 297/440.2

(58) Field of Classification Search
USPC ..... 297/16.1, 29, 55, 56, 57, 58, 440.2, 297/440.21
See application file for complete search history.

(56) References Cited

U.S. PATENT DOCUMENTS

| | | | | |
|---|---|---|---|---|
| D107,545 | S | 12/1937 | O'Connor | |
| 2,294,340 | A | 8/1942 | Irven | |
| 2,458,095 | A | 1/1949 | O'Connor | |
| 3,431,022 | A | 3/1969 | Poppe et al. | |
| D214,267 | S | 5/1969 | Moore et al. | |
| 5,706,613 | A * | 1/1998 | Drake et al. | 52/79.1 |
| 6,027,171 | A | 2/2000 | Partington et al. | |
| 6,036,272 | A | 3/2000 | Samples et al. | |
| D435,977 | S | 1/2001 | Ambasz | |
| D436,457 | S | 1/2001 | Ambasz | |
| D443,429 | S | 6/2001 | Mower et al. | |
| D452,619 | S | 1/2002 | Piretti | |
| D465,665 | S | 11/2002 | Ritchie et al. | |
| D466,712 | S | 12/2002 | Haney et al. | |
| D472,064 | S | 3/2003 | Haney et al. | |
| D472,723 | S | 4/2003 | Haney et al. | |
| D472,745 | S | 4/2003 | Haney et al. | |
| D473,059 | S | 4/2003 | Haney et al. | |
| 6,543,842 | B2 | 4/2003 | Haney | |
| D476,162 | S | 6/2003 | Finazzi | |
| D477,470 | S | 7/2003 | Haney et al. | |

(Continued)

OTHER PUBLICATIONS

U.S. Appl. No. 60/975,788, filed Sep. 27, 2007, van Nimwegen et al.

(Continued)

*Primary Examiner* — Philip Gabler
(74) *Attorney, Agent, or Firm* — Maschoff Brennan

(57) ABSTRACT

A chair may include a seat, a chair back and a frame that may be connected to the seat and/or chair back. The chair back and the frame may include engaging portions and/or receiving portions that may be sized and configured to contact, abut, engage and/or interlock with each other to connect the chair back to the frame. The engaging portions and/or receiving portions may be sized and configured to connect the chair back to the frame using a friction, interference and/or snap fit.

20 Claims, 6 Drawing Sheets

(56) References Cited

U.S. PATENT DOCUMENTS

| | | | | |
|---|---|---|---|---|
| D477,926 | S | 8/2003 | Haney et al. | |
| D477,939 | S | 8/2003 | Haney et al. | |
| D481,550 | S | 11/2003 | Astle | |
| D482,540 | S | 11/2003 | Ashby | |
| D482,543 | S | 11/2003 | Haney et al. | |
| D489,192 | S | 5/2004 | Jin et al. | |
| D498,071 | S | 11/2004 | Ashby et al. | |
| 6,871,906 | B2 * | 3/2005 | Haney | 297/55 |
| D506,325 | S | 6/2005 | Farber et al. | |
| D507,425 | S | 7/2005 | Ashby et al. | |
| D508,339 | S | 8/2005 | Astle | |
| 7,014,261 | B2 | 3/2006 | Haney | |
| 7,017,986 | B2 * | 3/2006 | Degen et al. | 297/58 |
| D519,292 | S | 4/2006 | Ashby | |
| D523,254 | S | 6/2006 | Nye et al. | |
| D544,225 | S | 6/2007 | Cantarutti | |
| 7,452,035 | B2 | 11/2008 | Astle et al. | |
| D655,932 | S | 3/2012 | Ashby et al. | |
| D667,649 | S | 9/2012 | Waite et al. | |
| D686,007 | S | 7/2013 | Johnson et al. | |
| 2003/0168894 | A1 * | 9/2003 | Lin | 297/55 |
| 2005/0104421 | A1 | 5/2005 | Astle et al. | |
| 2005/0121947 | A1 | 6/2005 | Haney | |
| 2007/0257524 | A1 * | 11/2007 | Huang | 297/16.1 |

OTHER PUBLICATIONS

U.S. Appl. No. 61/094,759, filed Sep. 5, 2008, van Nimwegen et al.
U.S. Appl. No. 61/239,736, filed Sep. 3, 2010, van Nimwegen et al.
International Search Report and Written Opinion from PCT International Application No. PCT/US2008/085564, dated Aug. 19, 2009, 8 pages.
U.S. Appl. No. 29/394,086, filed Jun. 13, 2011, Ashby et al.
U.S. Appl. No. 13/346,535, filed Jan. 9, 2012, Southwick, et al.
U.S. Appl. No. 13/346,580, filed Jan. 9, 2012, Johnson, et al.
U.S. Appl. No. 29/466,557, filed Sep. 9, 2013, Peery, et al.
Examination Report dated Nov. 15, 2013 from Canadian Patent Application No. 2,708,239.

* cited by examiner

FOLDING CHAIR WITH MOLDED COMPONENTS

CROSS-REFERENCE TO RELATED APPLICATIONS

This application claims priority to and the benefit of U.S. provisional patent application Ser. No. 60/992,834, filed Dec. 6, 2007, and entitled CHAIR.

This application claims priority to and the benefit of U.S. provisional patent application Ser. No. 61/050,461, filed May 5, 2008, and entitled CHAIR.

These applications are incorporated by reference in their entireties.

BACKGROUND OF THE INVENTION

1. Field of the Invention

The present invention generally relates to furniture and, in particular, to chairs.

2. Description of Related Art

Conventional chairs typically include a chair seat and a backrest, and are commonly used by one person. Chairs often have four legs to support the seat above a floor and the backrest may be connected to the seat and/or the legs. Chairs may also include arm rests, wheels to facilitate movement and may be adjustable in height.

Chairs can be constructed from a wide variety of materials such as wood, metal and molded plastic. Conventional chairs may also have a wide variety of designs depending upon factors such as intended use, ergonomics and appearance. In addition, known chairs may have various functional considerations such as size, portability, weight, durability and desired seating position.

Known chairs may also include padding, which may make the chair more comfortable to use. It is also known to construct chairs from flexible materials, such as wicker, which may make the chair more comfortable to use. Additionally, the chair seats and/or backrests may be contoured for increased comfort of the user.

Many conventional chairs are difficult and time consuming to manufacture. For example, some conventional chairs may include multiple parts and that may increase the amount of time required to assemble the chair. In addition, the multiple parts may increase the cost of the chair and the chair may be less durable because the parts may undesirably become disconnected or fail.

BRIEF SUMMARY OF THE INVENTION

A need therefore exists for a chair that eliminates or diminishes the disadvantages and problems described above.

One aspect is a chair that may include a chair seat and a chair back or backrest. A frame preferably connects the chair seat and the chair back. The chair seat and back, however, could also be interconnected.

Another aspect is a chair that may be folded and unfolded as desired. In particular, the chair may be a folding chair in which it can be folded into one position for storage and unfolded into another position for use.

Still another aspect is a chair that may include a frame and the chair seat may be connected to the frame by a support bracket. The support bracket may be connected to the chair seat by a snap, friction and/or interference fit. The support bracket may also be connected to the support bracket by fasteners, adhesives and the like. In addition, the chair may include one or more legs. The legs may be connected to the chair seat, form part of the frame and/or be part of a leg assembly. The legs may also be connected to any suitable portion of the chair. For example, the frame may include a pair of leg assemblies and each leg assembly may include a front leg and a rear leg, and the seat may be disposed between and connected to the leg assemblies. In particular, the seat may be pivotally connected to the front legs and the rear legs of the leg assemblies.

Yet another aspect is a chair that may include a seat that is attached to a pair of leg assemblies by a support bracket. For example, the leg assemblies may include a front leg and a rear leg and the bracket may be pivotally attached to the front leg and the rear leg. The seat may be connected to the leg assemblies by the bracket. The chair may also include a brace attached to the front leg and the rear leg of the leg assemblies. The brace, front leg, rear leg and bracket or seat of each leg assembly may form part of a four-bar, four-pivot linkage. If a leg assembly is disposed on each side of the chair seat, then a four-bar, four-pivot linkage may be disposed on each side of the chair.

A further aspect is a chair that may include a seat and backrest that is constructed of a lightweight material, such as plastic, and a frame constructed of a stronger material, such as a metal. The lightweight seat and backrest may include a hollow interior portion and may be formed through a suitable process such as injection molding, blow molding, compression molding or other molding process. The frame and the chair back may also be constructed from other materials with suitable characteristics and other appropriate processes.

A still further aspect is a chair that may include a frame and a chair back connected to the frame. The frame may include one or more receiving portions that are sized and configured to receive and/or retain a portion of the chair back. The receiving portions, which may consist of one or more slots, channels, grooves and the like, may extend along and be formed in a portion of the frame. The receiving portions may also include one or more projections (such as teeth) that may be sized and configured to engage, bite into and/or engage a portion of the chair back. In addition, the chair back may include one or more engaging portions that are sized and configured to be at least partially disposed in the receiving portions. In particular, the engaging portions may have angled or curved surfaces that are sized and configured to engage and/or be disposed in the receiving portions. The engaging portions may also be sized and configured to contact, abut and/or engage other portions of the frame. The chair back may also include other structures that are sized and configured to contact, abut and/or engage the frame, which may help securely connect the chair back and frame. The receiving portions and engaging portions are preferably sized and configured to allow the chair back to be connected to the frame by a snap, friction and/or interference and/or fit.

Yet another further aspect is a chair that may include a frame that allows the backrest to be positioned in a desired location. For example, the frame may include receiving portions that are specifically disposed to position the backrest in the desired location. A portion of the backrest may also be sized and configured to contact or engage the frame to help position the backrest in the desired location.

Another aspect is a chair that may include a chair back that is secured or locked into a fixed position when it is attached to the frame. For example, the chair back may include engaging portions, such as tabs, ramps, buttons, projections and the like, that are sized and configured to deform or deflect when the chair back is attached to the frame. Once the chair back is attached to the frame, then the engaging portions may resiliently return, at least partially, to their initial configuration to help retain the chair back in the desired position. This may advantageously allow the chair back to be quickly and easily secured in a desired position relative to the frame.

Still another aspect is a chair that may include a frame with receiving portions that are sized and configured to allow the chair back or backrest to be securely attached to the frame without the use of fasteners, adhesives, etc. Fasteners, adhesives and the like, however, can be used if desired. For example, the chair back may include engaging portions that are disposed along the sides of the chair back and engaging portions may be disposed in the upper portions of the frame. The engaging portions and/or receiving portions may include sections with different dimensions to allow the chair back to be securely attached to the frame. For instance, the engaging and/or receiving portions may include narrowed or tapered portions to help secure the backrest in a fixed position. The engaging and receiving portions may also include other features, such as inwardly and/or outwardly extending protrusions, dovetail portions, teeth and the like, which may help securely attach the chair back to the frame.

Yet another aspect is a chair that may include a frame with multiple receiving portions and a chair back with multiple engaging portions. For example, the frame may include two leg assemblies and multiple receiving portions may be disposed in upper portions of the frame. The chair back may include engaging portions that are sized and configured to be at least partially disposed in corresponding receiving portions of the frame. Advantageously, the multiple receiving and engaging portions may allow the chair back and frame to be securely connected. The chair may also have other suitable arrangements and configurations. For example, the frame may include one or more engaging and/or receiving portions, and the chair back may include one or more receiving and/or engaging portions, as desired.

A further aspect is a chair that may include a seat, a frame and a chair back that is constructed from blow-molded plastic. The blow-molded plastic chair back may include a front surface, a rear surface, a first side, a second side, a hollow interior portion at least partially disposed between the front surface and the rear surface, and one or more engaging portions that are sized and configured to attach the chair back to the frame. The front surface, the rear surface, the first side, the second side, the hollow interior portion and engaging portions may be integrally formed as part of a unitary, one-piece structure during the blow-molding process.

A still further aspect is a chair that may include a frame with a first receiving portion and a second receiving portion. The chair may also include a blow-molded plastic chair back with engaging portions that are formed during the blow-molding process. The engaging portions may include a first generally dovetail-shaped structure that is sized and configured to be at least partially disposed in the first receiving portion of the frame and a second generally dovetail-shaped structure that is sized and configured to be at least partially disposed in the second receiving portion of the frame. Advantageously, the dovetail-shaped structures and the receiving portions may allow the chair back and frame to be securely connected or interlocked. The first generally dovetail-shaped structure and the second generally dovetail-shaped structure are preferably integrally formed with the chair back as part of a unitary, one-piece structure during the blow-molding process.

Yet another further aspect a method of attaching a chair back to a chair frame. The method may include disposing an engaging portion of a molded plastic chair back into a receiving portion of the chair frame. The method may further include, prior to snapping the engaging portion of the molded plastic chair back into the receiving portion of the chair frame, integrally forming the engaging portion, the front surface, the rear surface and the hollow interior being integrally formed as part of a unitary, one-piece structure via a blow-molding process.

Another aspect is a chair that may include a seat, a frame connected to the seat, the frame including a first receiving portion and a second receiving portion, and a chair back constructed from blow-molded plastic, the chair back including a front surface, a rear surface, a first side, a second side and a hollow interior portion that are integrally formed as part of a unitary, one-piece construction. The chair back may also include a first engaging portion extending outwardly and away from the first side of the chair back, the first engaging portion being integrally formed with the chair back as part of the unitary, one-piece construction, the first engaging portion being disposed in and connected to the first receiving portion of the frame; and a second engaging portion extending outwardly and away from the second side of the chair back, the second engaging portion being integrally formed with the chair back as part of the unitary, one-piece construction, the second engaging portion being disposed in and connected to the second receiving portion of the frame. The first engaging portion may have a generally dovetail-shaped structure that is sized and configured to interlock with the first receiving portion of the frame, and the second engaging portion may have generally dovetail-shaped structure that is sized and interlock with the second receiving portion of the frame. In addition, the first engaging portion may have a hollow interior portion that is integrally formed with the chair back during the unitary, one-piece construction, the hollow interior portion of the first engaging portion being in direct communication with the hollow interior portion of the chair back; and the second engaging portion may have a hollow interior portion that is integrally formed with the chair back during the unitary, one-piece construction, the hollow interior portion of the second engaging portion being in direct communication with the hollow interior portion of the chair back.

Still another aspect is a chair that may include a seat, a frame connected to the seat, the frame including a receiving portion; and a blow-molded plastic chair back connected to the frame. The blow-molded plastic chair back may include a front surface, a rear surface, a first side, a second side, a hollow interior at least partially disposed between the front and rear surfaces, an engaging portion interlocking with the receiving portion of the frame and the engaging portion, the front surface, the rear surface, the first side, the second side and the hollow interior being integrally formed as part of a unitary, one-piece structure during a blow-molding process.

Yet another aspect is a method of attaching a molded plastic chair back to a chair frame, the method comprising snapping an engaging portion of the molded plastic chair back into a receiving portion of the chair frame, the molded plastic chair back including the engaging portion, a front surface, a rear surface, a hollow interior at least partially disposed between the front and rear surfaces, the engaging portion, the front surface, the rear surface and the hollow interior being integrally formed as part of a unitary, one-piece structure during a molding process.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention is generally directed towards a chair. The principles of the present invention, however, are not limited to chairs. It will be understood that, in light of the present disclosure, the chair disclosed herein can be successfully used in connection with other types of furniture and/or structures.

Additionally, to assist in the description of the chair, words such as top, bottom, front, rear, right and left may be used to describe the accompanying figures, which may be but are not necessarily drawn to scale. It will be appreciated, however, that the chair can be located in a variety of desired positions and/or orientations. A detailed description of the chair now follows.

Figure 2:
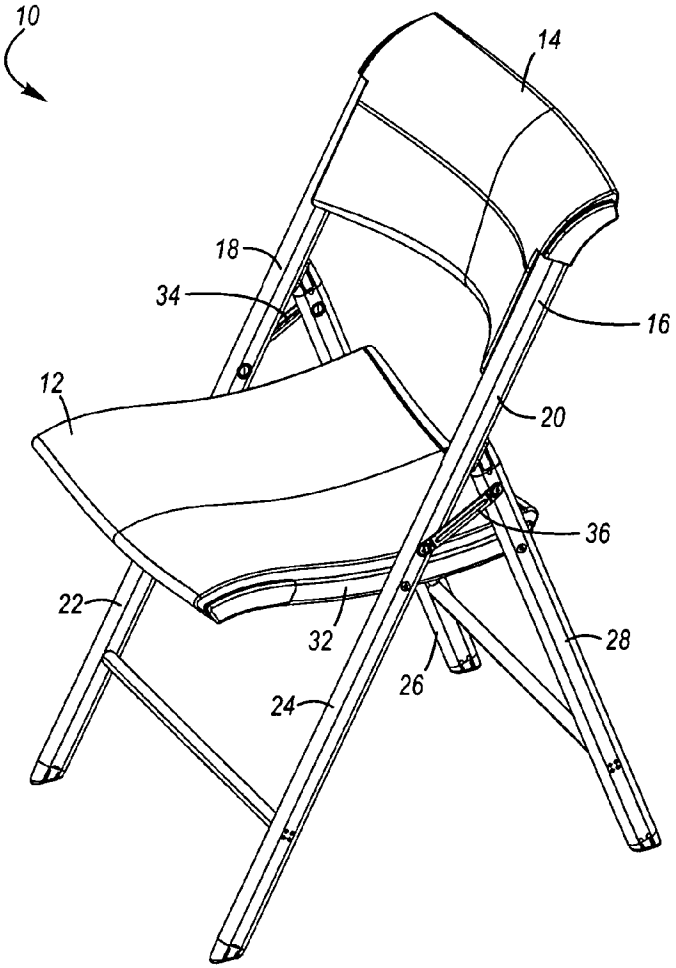
FIG. 2 is another perspective view of the chair shown in FIG. 1.
Figure 1:
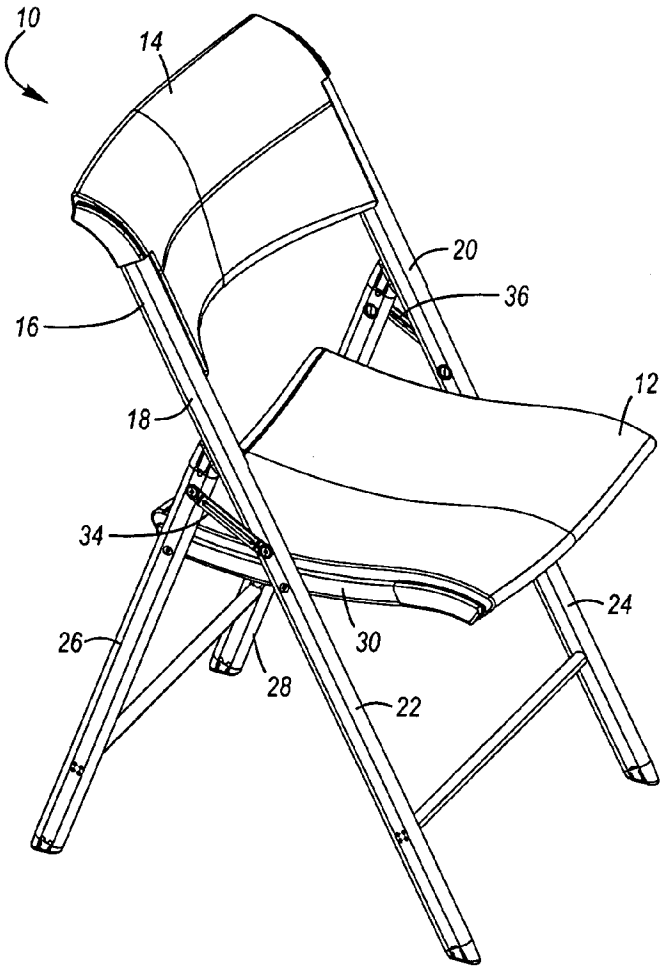
FIG. 1 is a perspective view of an exemplary chair.
Figure 4:
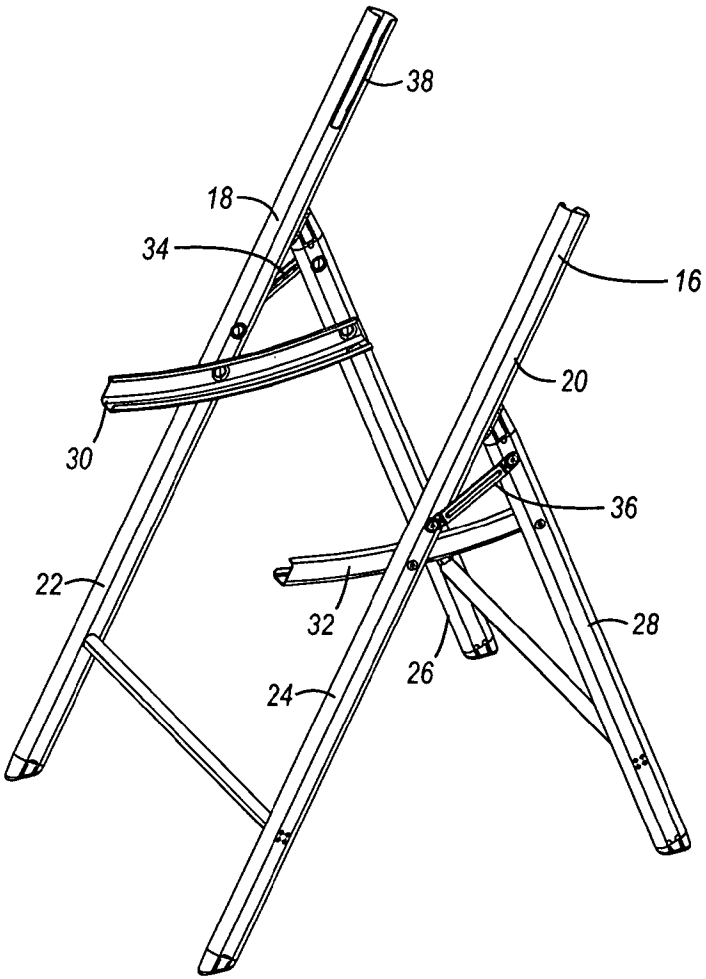
FIG. 4 is another perspective view of the portion of the chair shown in FIG. 3.
Figure 3:
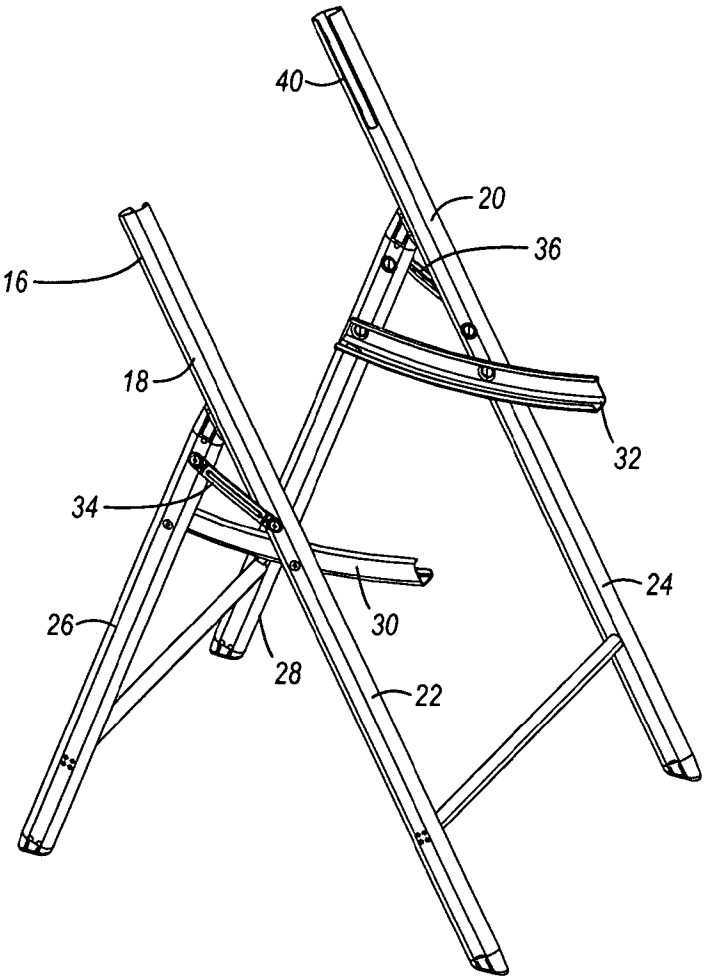
FIG. 3 is a perspective view of a portion of the chair shown in FIG. 1.

As shown in FIGS. 1-2, a chair 10 may include a seat 12 and a back or backrest 14. The chair 10 may also include a frame 16 that connects the seat 12 and the back 14. The frame 16 may be attached to the seat 12 and/or the back 14 by one or more fasteners; a friction, interference and/or snap fit connection and/or other suitable means.

The chair 10 may be sized and configured to be folded and unfolded. For example, the chair 10 may be a folding chair that may be folded into one position for storage and unfolded into another position for use.

The chair 10 may also include one or more legs or leg assemblies. For example, the chair 10 may include leg assemblies 18, 20 and the leg assemblies may form part of the frame 16. It will be appreciated that the legs do not have to be part of a leg assembly or frame, and the legs may be connected to any suitable portions of the chair 10.

In further detail, the leg assemblies 18, 20 may include a front leg or support 22, 24 and a rear leg or support 26, 28 and the seat 12 may be movably attached to the front and rear legs or supports by support brackets 30, 32. In particular, the support brackets 30, 32 may be movably connected to the front and rear legs 22, 24, 26, 28. The support brackets 30, 32 may also be attached to the seat 12 by a friction, interference and/or snap fit connection.

The seat 12 may be constructed from plastic, such as blow-molded plastic, and the support brackets 30, 32 may be constructed from metal. The blow-molded plastic seat 12 may include an upper surface, a lower surface and a hollow interior at least partially disposed between the upper and lower surfaces. The upper surface, the lower surface and the hollow interior of the blow-molded plastic seat 12 may be integrally formed as part of a unitary, one-piece structure during the blow-molding process. The chair 10 and seat 12 may have other suitable features, shapes, sizes, configurations and arrangements, such as disclosed in Assignee's U.S. Pat. No. 7,014,261, which is incorporated by reference in its entirety. It will be appreciated that the seat 12 and the support brackets 30, 32 may be constructed using other suitable materials and/or processes depending, for example, on the intended use of the chair 10.

The chair 10 may also include braces 34, 36 that are attached to the front and rear legs 22, 24, 26, 28 of the leg assemblies 18, 20. This may allow the front leg 22, the rear leg 26, the brace 34 and a portion of the seat 12 to form a four-bar linkage on one side of the chair; and the front leg 24, the rear leg 28, the brace 36 and another portion of the seat 12 to form a four-bar linkage on the other side of the chair. The four-bar linkage may allow the chair 10 to be folded by rotating the seat 12 with respect to the front legs 22, 24 so that the seat and rear legs 26, 28 fold into a position substantially parallel to the front legs. If desired, the seat 12 and the braces 34, 36 may be pivotally attached to the front and rear legs 22, 24, 26, 28, respectively such that the front legs, rear legs, braces and seat form a four-bar, four-pivot linkage that may facilitate folding and unfolding of the chair 10. It will be appreciated that the chair 10, the frame 16 and the leg assemblies 18, 20 need not be foldable and could have other suitable shapes, sizes, configurations and arrangements, if desired.

Figure 6:
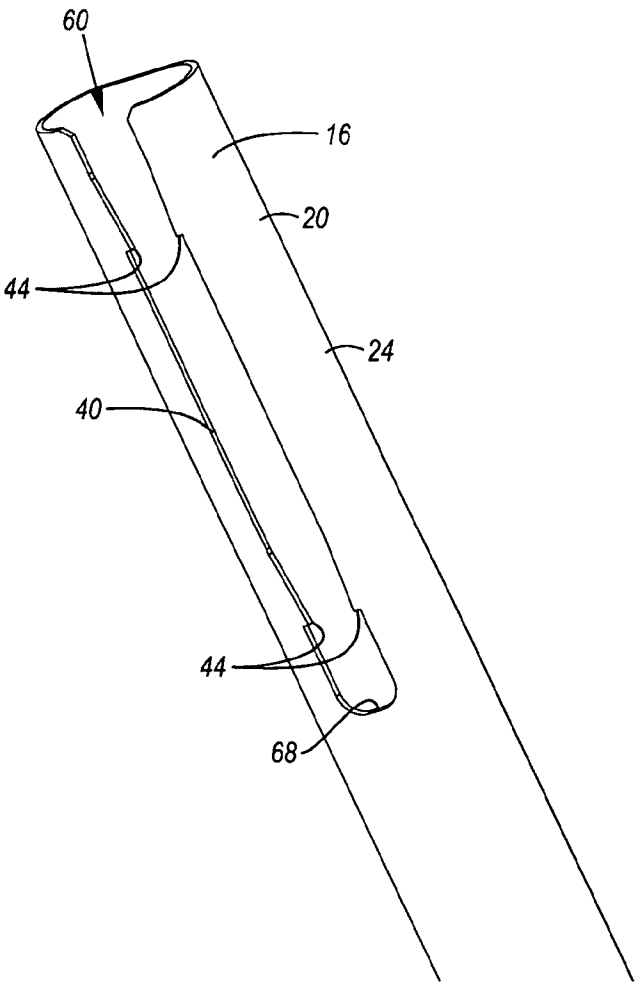
FIG. 6 is an enlarged perspective view of a portion of the chair shown in FIG. 3, illustrating an exemplary receiving portion.
Figure 5:
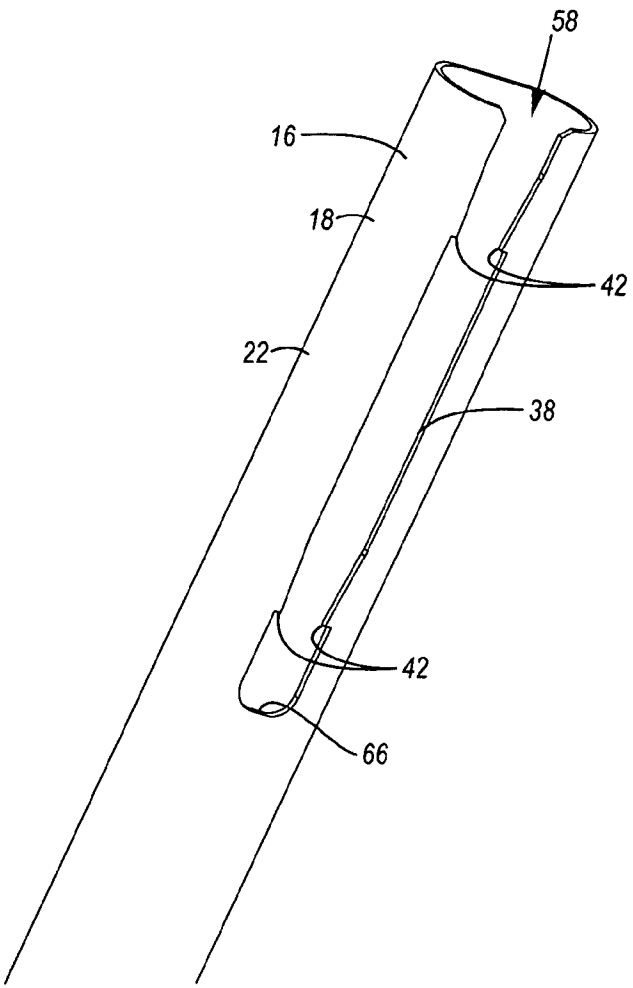
FIG. 5 is an enlarged perspective view of a portion of the chair shown in FIG. 4, illustrating an exemplary receiving portion.

The chair back 14 may be connected to the frame 16 by a friction, interference and/or snap fit connection. In particular, the frame 16 may include one or more receiving portions that are sized and configured to receive and/or retain a portion of the chair back 14. For example, as shown in FIGS. 5-6, the upper portions of the frame 16 (which may also be referred to as the upper portions of the legs 22, 24) may include receiving portions 38, 40, such as elongated slots, channels or grooves, which may extend along at least a portion of the length of the legs. The receiving portions 38, 40 may include one or more inwardly extending projections 42, 44, such as teeth. The projections 42, 44, may be sized and configured to engage and/or bite into the chair back 14. The receiving portions 38, 40 and projections 42, 44 may also provide a friction, interference and/or snap fit connection with the back 14.

The chair back 14 may include one or more engaging portions that are sized and configured to be at least partially disposed in the receiving portions of the frame 16. For example, as shown in FIGS. 7-10, the back 14 may include engaging portions 46, 48, such as dovetails, bayonet structures and the like, which are sized and configured to contact, abut, engage and/or interlock with the receiving portions 38, 40. The engaging portions 46, 48 may also be sized and configured to contact, abut, engage and/or interlock with other portions of the chair 10, such as the inner and/or outer surfaces of the frame 16. The receiving portions 38, 40 and the engaging portions 46, 48 may allow the chair back 14 and frame 16 to be securely connected.

Figure 8:
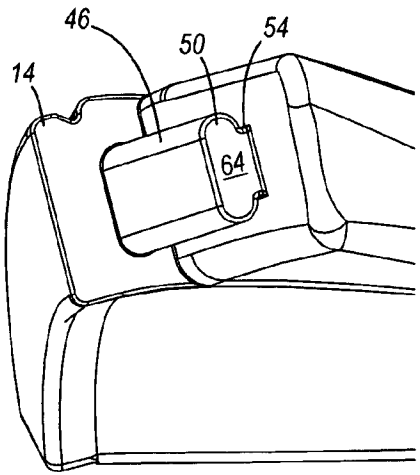
FIG. 8 is an enlarged view a portion of the chair back shown in FIG. 7, illustrating an exemplary engaging portion.
Figure 10:
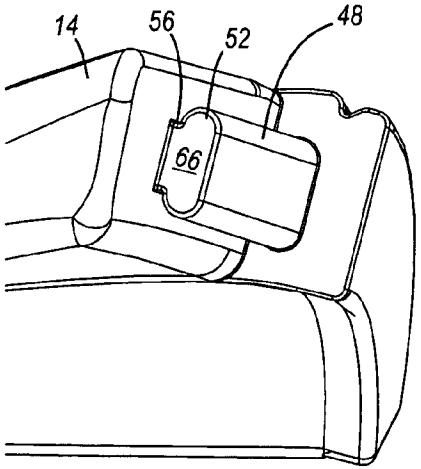
FIG. 10 is an enlarged view of a portion of the chair back shown in FIG. 9, illustrating an exemplary engaging portion.
Figure 7:
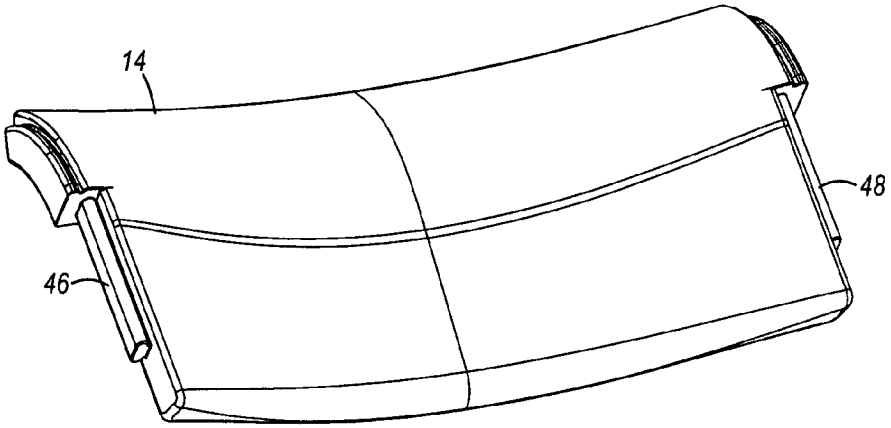
FIG. 7 is an enlarged perspective view of a portion of the chair shown in FIG. 1, illustrating an exemplary chair back.
Figure 9:
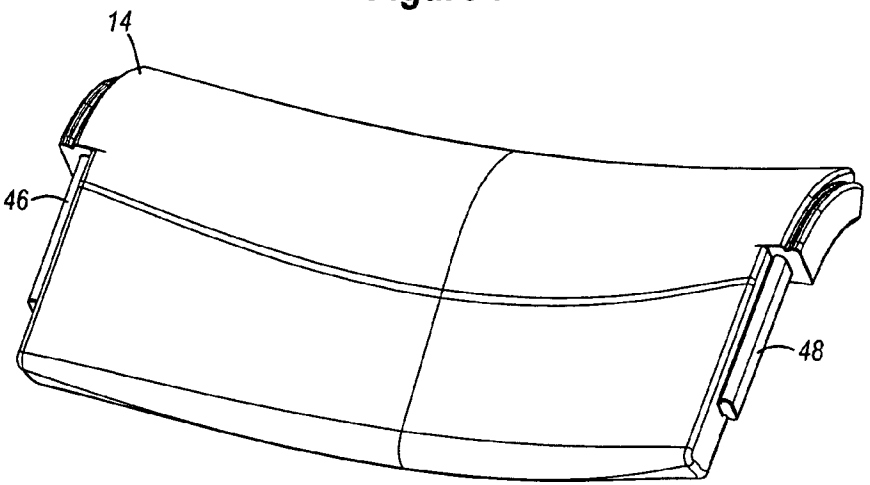
FIG. 9 is another perspective view of the chair back shown in FIG. 7.

The receiving portions 38, 40 and the engaging portions 46, 48 may also allow the chair back 14 and the frame 16 to be connected by a friction, interference and/or snap fit connection. For example, as best shown in FIGS. 8 and 10, the engaging portions 46, 48 may have a dovetail-shaped configuration having a broader head 50, 52 and a narrower base 54, 56. In addition, as best shown in FIGS. 7 and 9, the engaging portions 46, 48 may have a length that is at least about 25 percent, 35 percent, 50 percent or more of the height of the chair back 14.

The engaging portions 46, 48 are preferably sized and configured to be disposed in receiving portions 38, 40 disposed in the upper portion of the frame 16. In particular, the receiving portions 38, 40 are preferably disposed in the upper portions of the legs 20, 22 when the legs form a portion of the frame 16. For example, as best seen in FIGS. 5-6, the receiving portions 38, 40 may be disposed in the upper portions of the legs 22, 24 and the legs may have open ends 58, 60 to facilitate connection to the engaging portions 46, 48. In particular, the bases 54, 56 of the engaging portions 46, 48 may be inserted into the receiving portions 38, 40 via the open ends 58, 60. As the bases 54, 56 are inserted into the receiving portions 38, 40, the projections 42, 44 of the receiving portions may engage, bite into and/or provide a friction, interference and/or snap fit connection with the bases. In addition, as the bases 54, 56 are inserted into the receiving portions 38, 40, the heads 50, 52 of the engaging portions may be inserted into hollow interiors of the legs 22, 24. This may allow the heads 50, 52 to contact, abut, engage and/or interlock with an inner surface of the legs 22, 24, which may also provide a friction, interference and/or snap fit connection.

The receiving portions 38, 40 are preferably sized and configured to position the backrest 14 in the desired location. For example, the engaging portions 46, 48 may include an end 64, 66 that is sized and configured to contact, abut and/or engage an end 66, 68 of the receiving portions 38, 40, respectively, to position the chair back 14 in the desired location relative to the frame 14 and/or legs 22, 24.

Figure 13:
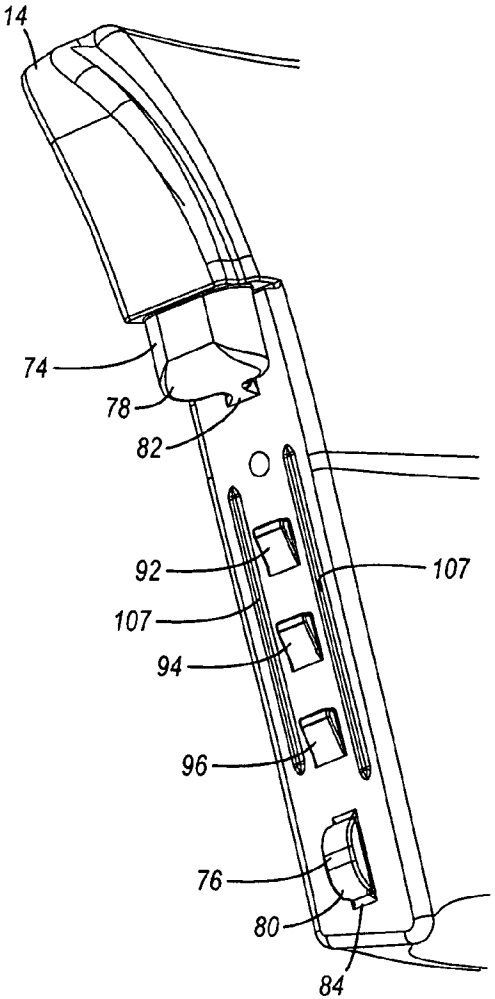
FIG. 13 is a perspective view of a portion of a chair back, illustrating exemplary engaging portions.
Figure 12:
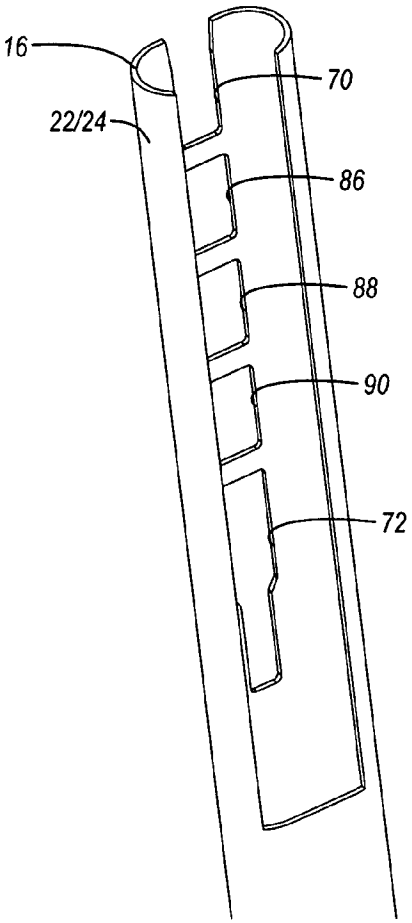
FIG. 12 is another perspective view of the portion of a chair frame shown in FIG. 11.
Figure 11:
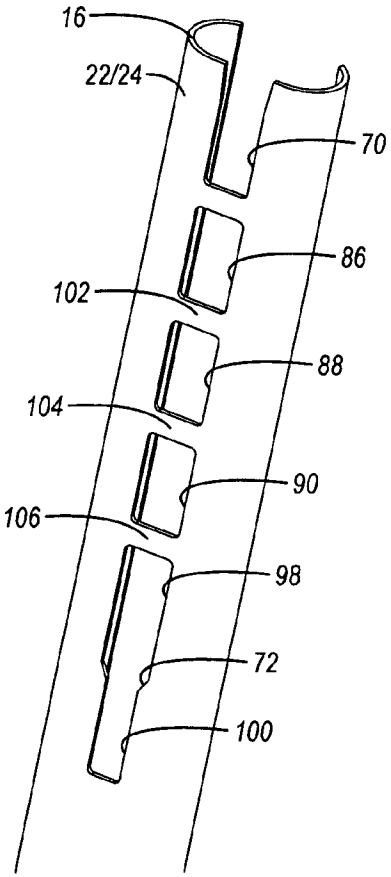
FIG. 11 is a perspective view of a portion of a chair frame, illustrating exemplary receiving portions.

It will be appreciated that the receiving portions 38, 40 and the engaging portions 46, 48 may have other suitable shapes, sizes, configurations and/or arrangements depending, for example, upon the intended use of the chair 10. For example, as shown in FIGS. 11-13, the legs 22, 24 may include receiving portions 70, 72 that are sized and configured to receive and/or retain corresponding engaging portions 74, 76 of the chair back 14. For instance, the receiving portions 70 may have an open end and the engaging portions 74, 76 may have a dovetail-shaped configuration having a broader head 78, 80 and a narrower base 82, 84. To connect the chair back 14 to the leg 22, 24, the bases 82, 84 may be inserted into the receiving portions 70, 72 and the heads 78, 80 may be inserted into hollow interior portions of the leg 22, 24. As the bases 82, 84 are inserted into the receiving portions 70, 72, the receiving portions may engage or bite into the bases, which may help securely connect the chair back 14 to the frame 16. In addition, the chair back 14 and the frame 16 may be connected by a friction, interference and/or snap fit connection. In addition, as the heads 78, 80 of the engaging portions are inserted into hollow interiors of the leg 22, 24, the heads may contact, abut, engage and/or interlock with an inner surface of the leg 22, 24, which may also help create a friction, interference and/or snap fit connection.

The leg 22, 24 may also include receiving portions 86, 88, 90, which may be sized and configured to respectively receive and/or retain engaging portions 92, 94, 96 of chair the back 14. The engaging portions 92, 94, 96 preferably include projections (such as tabs, ramps, buttons or the like) that deform or deflect from an initial configuration to allow the back 14 to be attached to the leg 22, 24. When the engaging portions 92, 94, 96 are disposed in the receiving portions 86, 88, 90, the engaging portions may at least partially resiliently return to their initial configuration to help retain the back in the desired position. This may advantageously allow the back 14 to be quickly and easily secured in the desired position.

In further detail, the engaging portion 76 may be inserted into an upper end 98 of the receiving portion 72 and the engaging portions 92, 94, 96 may be inserted into the receiving portions 86, 88, 90. The back 14 may then be moved such that the base 84 of the engaging portion 76 is received by a lower end 100 of the receiving portion 72 and the base 82 of the engaging member 74 is received by the receiving portion 70 via its open end. As mentioned above, this may help provide a friction, interference and/or snap fit connection.

In addition, as the back 14 is connected to the frame 16, the engaging portion 92 may move from the receiving portion 86 to the receiving portion 88, the engaging portion 94 may move from the receiving portion 88 to the receiving portion 90, and the engaging portion 96 may move from the receiving portion 90 to the upper end 98 of the receiving portion 72. This may allow the engaging portions 92, 94, 96 to contact and/or engage detents 102, 104, 106, which may cause the engaging portions to deform or deflect from an initial configuration. To help facilitate this deformation or deflection, the engaging portions 92, 94, 96 may have a tapered and/or ramp-shaped configuration. When the engaging portions 92, 94, 96 arrive at and are received by the receiving portions 88, 90, 72, the engaging portions may resiliently return, at least partially, to their initial configuration to help retain the back 14 in a desired position. In particular, with the engaging portions returned to their initial configuration, the detents 102, 104, 106 may be positioned to contact, abut, engage and/or interlock with an upper end of the engaging portions 92, 94, 96 to help retain the back 14 in the desired position.

As shown in FIG. 13, the chair back 14 may also include projections with different shapes, sizes, configuration and arrangements. These projections, which preferably extend outwardly from the sides of the chair back 14, may have different features or purposes. Thus, some of the projections may be for alignment purposes, cosmetic purposes, functional purposes and the like. For example, the chair back 14 may include one or more elongated projections in which the length is much greater than the width. These elongated projections may be referred to as covers 107 and the covers may be sized and configured to hide at least a portion of the projections 92, 94, 96 from view. In particular, the covers 107 may be generally aligned with the projections 92, 94, 96 and may, when the back 14 is connected to the frame 16, help hide the projections from view by spanning a gap between the back and frame. The covers 107 may also provide other features or functions such as correctly positioning the chair back 14 relative to the frame 16, engaging desired portions of the frame (such as the inner edges of the receiving portions), facilitating connection of the chair back to the frame, and the like. Thus, it will be appreciated that the chair back can include multiple engaging portions or projections and these engaging portions or projections may have different shapes, sizes, configurations and arrangements depending, for example, upon the intended use or function of the engaging portions or projections.

Figure 16:
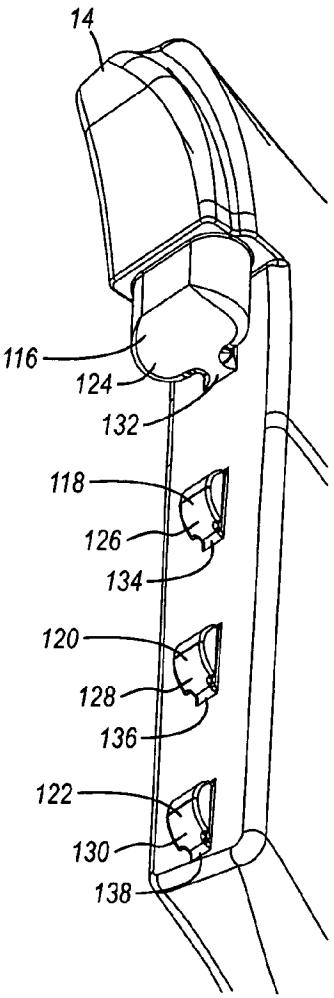
FIG. 16 is a perspective view of a portion of a chair back, illustrating exemplary engaging portions.
Figure 15:
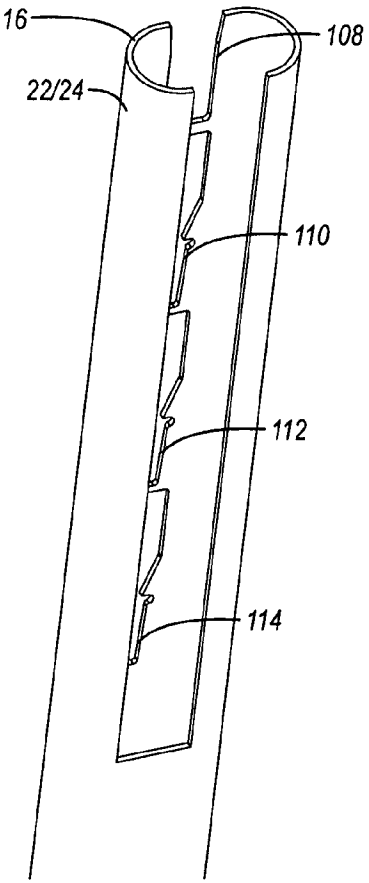
FIG. 15 is another perspective view of the portion of a chair frame shown in FIG. 14.
Figure 14:
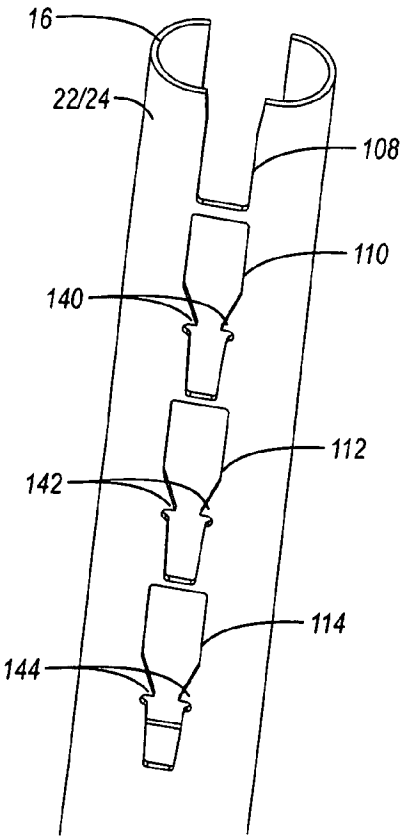
FIG. 14 is a perspective view of a portion of a chair frame, illustrating exemplary receiving portions.

For example, as shown in FIGS. 14-16, the legs 22, 24 of the frame 16 may include receiving portions 108, 110, 112, 114, which may be sized and configured to respectively receive and/or retain engaging portions 116, 118, 120, 122 of the chair back 14. As shown in the accompanying figures, the receiving portion 108 may have an open end, and the engaging portions 116, 118, 120, 122 may have a dovetail-shaped configuration with a broader head 124, 126, 128, 130 and a narrower base 132, 134, 136, 138. To connect the back 14 to the leg 22, 24, the bases 134, 136, 138 may be inserted into an upper end of the receiving portions 110, 112, 114 and the heads 126, 128, 130 may be inserted into hollow interior portions of the leg 22, 24. The back 14 may then be moved such that the base 132 of the engaging portion 116 is received by the receiving portion 108 and the bases 134, 136, 138 move from the broader upper end to the narrower lower end of the receiving portions 110, 112, 114. As the bases 134, 136, 138 move towards the lower end of the receiving portions 110, 112, 114, one or more teeth 140, 142, 144 may engage and/or bite into the bases. In addition, the heads 124, 126, 128, 130 may contact, abut, engage and/or interlock with an inner surface of the leg 22, 24, which may help create a friction, interference and/or snap fit connection.

The chair back 14 may be constructed from plastic and it may include a front surface, a rear surface and a hollow interior portion at least partially disposed between the front and rear surfaces. Preferably the chair back 14 is constructed from blow-molded plastic and the hollow interior portion may be constructed during the blow-molding process. In addition, the front surface, the rear surface and the hollow interior portion may be integrally formed as part of a unitary, one-piece structure during the blow-molding process. The chair back 14, however, need not be constructed from blow-molding plastic and it could be constructed from other suitable materials and processes, such as injection molding, compression molding and the like.

The chair back 14 may also include other features and these other features may be integrally formed with the chair back as part of the unitary, one-piece structure. For example, the engaging portions 46, 48, 74, 76, 92, 94, 96, 116, 118, 120, 122 and/or the covers 107 may be integrally formed with the chair back 14 as part of the unitary, one-piece structure. In particular, the engaging portions 46, 48, 74, 76, 92, 94, 96, 116, 118, 120, 122 and/or the covers 107 may be integrally formed with the chair back 14 as part of the unitary, one-piece structure during a blow-molding process. Constructing the chair back 14 and accompanying features as a unitary, one-piece structure may advantageously help reduce manufacturing time and decrease costs because the engaging portions 46, 48, 74, 76, 92, 94, 96, 116, 118, 120, 122 and/or the covers 107 need not be separately formed and then attached to the back 14. It will be appreciated, however, that the chair back 14 and accompanying features or components do not have to be integrally formed as part of a unitary, one-piece structure and these features or components may be separately formed, manufactured and assembled, as desired.

In addition, the back 14, the engaging portions 46, 48, 74, 76, 92, 94, 96, 116, 118, 120, 122 and/or the covers 107 may include hollow interior portions and these hollow interior portions may be formed during the blow-molding process. If desired, the hollow interiors of the engaging portions 46, 48, 74, 76, 92, 94, 96, 116, 118, 120, 122 and/or the covers 107 may be in communication with the hollow interior portion of the back 14.

The frame 16, the leg assemblies 18, 20 and/or the legs 22, 24 may be constructed from metal, for example, metal tubes. Significantly, the metal tubes may be strong, yet lightweight. Moreover, the metal frame 16, the leg assemblies 18, 20 and/or the legs 22, 24 may be stronger than the plastic back 14, which may allow the receiving portions 38, 40, 70, 72, 86, 88, 90, 108, 110, 112, 114 and/or the teeth 42, 44, 140, 142, 144 to bite into and/or engage the plastic back 14, if desired. It will be appreciated, however, that the frame 16, the leg assemblies 18, 20 and the legs 22, 24 need not be constructed from metal and may be constructed from other materials having other suitable characteristics. It will also be appreciated that the back 14 and the engaging portions 46, 48, 74, 76, 92, 94, 96, 116, 118, 120, 122 need not be constructed from plastic and may be constructed from other suitable materials having other suitable characteristics.

As discussed above, the chair back 14 may be securely connected to the frame 16. Advantageously, the receiving portions and engaging portions may help securely connect the chair back 14 to the frame 16. In addition, the chair back 14 and the frame 16 may include any suitable number for receiving portions and engaging portions, and the receiving portions and engaging portions may have different shapes, sizes, configurations and arrangements depending, for example, upon the intended use of the chair 10. Preferably the chair back 14 may be attached to the frame 16 without the use of fasteners or other materials, such as adhesives, but fasteners or other materials can be used if desired. Further, the receiving portions and engaging portions are preferably sized and configured to help prevent the chair back 14 from being unintentionally or inadvertently removed from the frame 16. That is, the receiving portions and engaging portions are preferably sized and configured to allow the chair back 14 to be quickly and easily attached to the frame 16, and prevent or make it difficult to unintentionally remove the chair back from the frame.

Further, the engaging and receiving portions are preferably sized and configured to facilitate securely attaching the chair back 14 to the frame 16. For example, the engaging and receiving portions may include sections with different dimensions to allow the back 14 to be securely attached to the frame 16. For instance, the engaging and/or receiving portions may include narrowed or tapered portions to help secure the back in a fixed position. The engaging and receiving portions may also include other features, such as inwardly and/or outwardly extending protrusions, dovetail portions, teeth and the like, which may help securely attach the back 14 to the frame 16. It will be appreciated, however, that other receiving portions and engaging portions have other suitable sizes, shapes, configurations and locations may be used to help connect the back 14 to the frame 16. Moreover, the frame 16 could include engaging portions and the back 14 could include corresponding receiving portions, if desired.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A chair comprising:

a first leg assembly comprising:

a first leg having a generally tubular configuration and an open upper end;

a second leg; and a receiving portion in an upper portion of the first leg, the receiving portion comprising an elongated slot in an outer wall of the first leg, the elongated slot extending from the open upper end along a length of the first leg to an end of the slot; and a second leg assembly comprising:

a first leg having a generally tubular configuration and an open upper end;

a second leg; and a receiving portion in an upper portion of the first leg, the receiving portion comprising an elongated slot in an outer wall of the first leg, the elongated slot extending from the open upper end along a length of the first leg to an end of the slot;

a seat connected to the first leg assembly and the second leg assembly; and a chair back connected to the first leg assembly and the second leg assembly, the chair back constructed from blow-molded plastic, the chair back comprising:

a first engaging portion extending outwardly and away from a first side of the chair back, the first engaging portion including a base disposed within the slot in the outer wall of the first leg of the first leg assembly and a head disposed within a hollow interior portion of the generally tubular first leg of the first leg assembly, the head being larger than the base to prevent the head from passing through the slot; and a second engaging portion extending outwardly and away from a second side of the chair back, the second engaging portion including a base disposed within the slot in the outer wall of the first leg of the second leg assembly and a head disposed within a hollow interior portion of the generally tubular first leg of the second leg assembly, the head being larger than the base to prevent the head from passing through the slot;

wherein the head and the base of the first engaging portion, the head and the base of the second engaging portion and the chair back are integrally formed as part of a unitary, one-piece construction during a blow-molding process;

wherein the first engaging portion of the chair back is slid into the open upper end of the first leg of the first leg assembly and into the elongated slot in the outer wall of the first leg to connect the chair back to the first leg of the first leg assembly, the base and the slot engaged in an interference fit to secure the chair back to the first leg of the first leg assembly; and wherein the second engaging portion of the chair back is slid into the open upper end of the first leg of the second leg assembly and into the elongated slot in the outer wall of the first leg to connect the chair back to the first leg of the second leg assembly, the base and the slot engaged in an interference fit to secure the chair back to the first leg of the second leg assembly.

2. The chair as in claim 1, wherein the first engaging portion on the first side of the chair back has a generally dovetail-shaped structure that is sized and configured to interlock with the receiving portion of the first leg assembly; and wherein the second engaging portion on the second side of the chair back has a generally dovetail-shaped structure that is sized and interlock with the receiving portion of the second leg assembly.

3. The chair as in claim 1, wherein the first engaging portion on the first side of the chair back and the second engaging portion on the second side of the chair back deform from an initial configuration to allow the chair back to be connected to the first leg assembly and the second leg assembly; and wherein the first engaging portion on the first side of the chair back and the second engaging portion on the second side of the chair back resiliently return to the initial configuration to help connect the chair back to the first leg assembly and the second leg assembly.

4. The chair as in claim 1, wherein the elongated slot of the receiving portion of the first leg assembly includes a first edge and an opposing second edge, at least a portion of the first edge is tapered relative to at least a portion of the second edge to vary a distance between the first edge and the second edge; and wherein the elongated slot of the receiving portion of the second leg assembly includes a first edge and an opposing second edge, at least a portion of the first edge is tapered relative to at least a portion of the second edge to vary a distance between the first edge and the second edge.

5. The chair as in claim 1, further comprising:

one or more teeth extending inwardly from a first edge of the elongated slot of the first leg assembly;

one or more teeth extending inwardly from a second edge of the elongated slot of the first leg assembly;

one or more teeth extending inwardly from a first edge of the elongated slot of the second leg assembly; and one or more teeth extending inwardly from a second edge of the elongated slot of the second leg assembly.

6. The chair as in claim 1, further comprising:

a third engaging portion extending outwardly and away from the first side of the chair back, the third engaging portion on the first side of the chair back being integrally formed with the chair back as part of the unitary, one-piece construction;

wherein the third engaging portion on the first side of the chair back is slid into the open upper end of the first leg of the first leg assembly and into the elongated slot that extends along the length of the first leg.

7. The chair as in claim 1, further comprising:

a third engaging portion extending outwardly and away from the first side of the chair back, the third engaging portion on the first side of the chair back being integrally formed with the chair back as part of the unitary, one-piece construction; and a second receiving portion in the upper portion of the first leg of the first leg assembly, the third engaging portion on the first side of the chair back being disposed in and connected to the second receiving portion of the first leg of the first leg assembly.

8. The chair as in claim 1, wherein the receiving portion of the first leg assembly and the receiving portion of the second leg assembly are facing one another, have generally the same width and have generally the same length measured from the open upper end to the end of the slot.

9. The chair as in claim 1, wherein the receiving portion of the first leg assembly further comprises one or more inwardly extending projections that engage the base of the first engaging portion on the first side of the chair back; and wherein the receiving portion of the second leg assembly further comprises one or more inwardly extending projections that engage the base of the second engaging portion on the second side of the chair back.

10. The chair as in claim 1, wherein the chair back includes a hollow interior portion, the first engaging portion on the first side of the chair back includes a hollow interior portion and the second engaging portion on the second side of the chair back includes a hollow interior portion, the hollow interior portions of the chair back, the first engaging portion and the second engaging portion being integrally formed during the blow-molding process as part of the unitary, one-piece structure.

11. A chair comprising:

a first leg assembly comprising:

a first support having a generally hollow configuration and an open upper end;

a second support; and a receiving portion in an upper portion of the first support, the receiving portion comprising an elongated opening in an outer wall of the first support, the elongated opening extending from the open upper end along a length of the first support to an end of the opening; and a second leg assembly comprising:

a first support having a generally tubular configuration and an open upper end;

a second support; and a receiving portion in an upper portion of the first support, the receiving portion comprising an elongated opening in an outer wall of the first support, the elongated opening extending from the open upper end along a length of the first support to an end of the opening;

a seat connected to the first leg assembly and the second leg assembly; and a chair back connected to the first leg assembly and the second leg assembly, the chair back constructed from blow-molded plastic, the chair back comprising:

a first engaging portion extending outwardly and away from a first side of the chair back, the first engaging portion including a base disposed within the opening in the outer wall of the first support of the first leg assembly and a head disposed within a hollow interior portion of the generally hollow first support of the first leg assembly; and a second engaging portion extending outwardly and away from a second side of the chair back, the second engaging portion including a base disposed within the opening in the outer wall of the first support of the second leg assembly and a head disposed within a hollow interior portion of the generally tubular first support of the second leg assembly;

wherein the head and the base of the first engaging portion, the head and the base of the second engaging portion and the chair back are integrally formed as part of a unitary, one-piece construction during a blow-molding process;

wherein the first engaging portion of the chair back is slid into the open upper end of the first support of the first leg assembly and into the elongated opening in the outer wall of the first support to connect the chair back to the first support of the first leg assembly, the head and the slot engaged in an interference fit to secure the chair back to the first support of the first leg assembly; and wherein the second engaging portion of the chair back is slid into the open upper end of the first support of the second leg assembly and into the elongated opening in the outer wall of the first support to connect the chair back to the first support of the second leg assembly, the head and the slot engaged in an interference fit to secure the chair back to the first support of the second leg assembly.

12. The chair as in claim 11, wherein the first engaging portion on the first side of the chair back has a generally dovetail-shaped structure that is sized and configured to interlock with the receiving portion of the first leg assembly; and wherein the second engaging portion on the second side of the chair back has a generally dovetail-shaped structure that is sized and interlock with the receiving portion of the second leg assembly.

13. The chair as in claim 11, wherein the first engaging portion on the first side of the chair back and the second engaging portion on the second side of the chair back deform from an initial configuration to allow the chair back to be connected to the first leg assembly and the second leg assembly; and wherein the first engaging portion on the first side of the chair back and the second engaging portion on the second side of the chair back resiliently return to the initial configuration to help connect the chair back to the first leg assembly and the second leg assembly.

14. The chair as in claim 11, wherein the elongated opening of the receiving portion of the first leg assembly includes a first edge and an opposing second edge, at least a portion of the first edge is tapered relative to at least a portion of the second edge to vary a distance between the first edge and the second edge; and wherein the elongated opening of the receiving portion of the second leg assembly includes a first edge and an opposing second edge, at least a portion of the first edge is tapered relative to at least a portion of the second edge to vary a distance between the first edge and the second edge.

15. The chair as in claim 11, further comprising:

one or more teeth extending inwardly from a first edge of the elongated opening of the first leg assembly;

one or more teeth extending inwardly from a second edge of the elongated opening of the first leg assembly;

one or more teeth extending inwardly from a first edge of the elongated opening of the second leg assembly; and one or more teeth extending inwardly from a second edge of the elongated opening of the second leg assembly.

16. The chair as in claim 11, further comprising:

a third engaging portion extending outwardly and away from the first side of the chair back, the third engaging portion on the first side of the chair back being integrally formed with the chair back as part of the unitary, one-piece construction;

wherein the third engaging portion on the first side of the chair back is slid into the open upper end of the first support of the first leg assembly and into the elongated opening that extends along the length of the first support.

17. The chair as in claim 11, further comprising:

a third engaging portion extending outwardly and away from the first side of the chair back, the third engaging portion on the first side of the chair back being integrally formed with the chair back as part of the unitary, one-piece construction; and a second receiving portion in the upper portion of the first support of the first leg assembly, the third engaging portion on the first side of the chair back being disposed in and connected to the second receiving portion of the first support of the first leg assembly.

18. The chair as in claim 11, wherein the receiving portion of the first leg assembly and the receiving portion of the second leg assembly are facing one another, have generally the same width and have generally the same length measured from the open upper end to the end of the opening.

19. The chair as in claim 11, wherein the receiving portion of the first leg assembly further comprises one or more inwardly extending projections that engage the base of the first engaging portion on the first side of the chair back; and wherein the receiving portion of the second leg assembly further comprises one or more inwardly extending projections that engage the base of the second engaging portion on the second side of the chair back.

20. The chair as in claim 11, wherein the chair back includes a hollow interior portion, the first engaging portion on the first side of the chair back includes a hollow interior portion and the second engaging portion on the second side of the chair back includes a hollow interior portion, the hollow interior portions of the chair back, the first engaging portion and the second engaging portion being integrally formed during the blow-molding process as part of the unitary, one-piece structure.

* * * * *